US010147385B2

(12) United States Patent
Chen et al.

(10) Patent No.: US 10,147,385 B2
(45) Date of Patent: Dec. 4, 2018

(54) ONLINE GAMMA ADJUSTMENT SYSTEM OF LIQUID CRYSTAL

(71) Applicant: Shenzhen China Star Optoelectronics Technology Co., Ltd., Shenzhen, Guangdong (CN)

(72) Inventors: Yu-yeh Chen, Guangdong (CN); Yu Wu, Guangdong (CN); Jianjun Xie, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 97 days.

(21) Appl. No.: 15/303,573

(22) PCT Filed: Jul. 12, 2016

(86) PCT No.: PCT/CN2016/089743
§ 371 (c)(1),
(2) Date: Oct. 12, 2016

(87) PCT Pub. No.: WO2017/190426
PCT Pub. Date: Nov. 9, 2017

(65) Prior Publication Data

US 2018/0144709 A1 May 24, 2018

(30) Foreign Application Priority Data

May 4, 2016 (CN) ..... 2016 1 0289154

(51) Int. Cl.
*G09G 3/36* (2006.01)

(52) U.S. Cl.
CPC ..... *G09G 3/3696* (2013.01); *G09G 3/36* (2013.01); *G09G 2310/0289* (2013.01); *G09G 2320/0673* (2013.01)

(58) Field of Classification Search
CPC ..... G09G 3/3696; G09G 3/36; G09G 2310/0289; G09G 2320/0673; G09G 2330/028
See application file for complete search history.

(56) References Cited

U.S. PATENT DOCUMENTS 7,724,171 B2 * 5/2010 Lee ..... G09G 3/3688 341/120
8,493,375 B2 * 7/2013 Bae ..... G09G 3/3208 345/211

(Continued)

FOREIGN PATENT DOCUMENTS

CN 101211035 A 7/2008
CN 201097032 Y 8/2008

(Continued)

*Primary Examiner* — Tom Sheng
(74) *Attorney, Agent, or Firm* — Andrew C. Cheng

(57) ABSTRACT

An online gamma adjustment system of liquid crystal panel is disclosed. The system includes a port receiving a gamma encoding for adjusting from an external gamma adjustment device, and generating an enable signal; a storage device storing the gamma encoding for adjusting received by the port according to a voltage level status of the enable signal; a controller selectively reading the gamma encoding from the storage device according to voltage level status of the enable signal; and a gamma register receiving the gamma encoding read by the controller, outputting a gamma voltage corresponding to the gamma encoding read by the controller in order to drive a liquid crystal panel.

10 Claims, 3 Drawing Sheets

(56) References Cited

U.S. PATENT DOCUMENTS

| | | | | |
|---|---|---|---|---|
| 2004/0174388 | A1* | 9/2004 | Sempel | G09G 3/20 345/691 |
| 2006/0055572 | A1 | 3/2006 | Choe | |
| 2007/0013725 | A1* | 1/2007 | Burkhardt | G09G 3/2007 345/690 |
| 2007/0262972 | A1* | 11/2007 | Nakata | G09G 3/3696 345/204 |
| 2010/0245319 | A1* | 9/2010 | Park | G09G 3/3233 345/211 |
| 2011/0298764 | A1* | 12/2011 | Ha | G09G 3/20 345/207 |

FOREIGN PATENT DOCUMENTS

| | | | |
|---|---|---|---|
| CN | 102063879 | A | 5/2011 |
| CN | 102254530 | A | 11/2011 |
| CN | 103325349 | A | 9/2013 |
| CN | 103345896 | A | 10/2013 |
| CN | 104751817 | A | 7/2015 |
| CN | 105185350 | A | 12/2015 |

* cited by examiner

ONLINE GAMMA ADJUSTMENT SYSTEM OF LIQUID CRYSTAL

BACKGROUND OF THE INVENTION

1. Field of the Invention

The present invention relates to a liquid crystal display technology field, and more particularly to an online gamma adjustment system of liquid crystal panel.

2. Description of Related Art

In the manufacturing of liquid crystal panels, the liquid crystal panels in a same batch will be burned gamma encoding with a same version. However, the liquid crystal panels have difference. The gamma encoding with the same version is not the best for each liquid crystal panel, and the gamma curve may not meet the specification so that the product quality is decreased. Currently, online gamma encoding adjustment technology is developed to ensure that the gamma encoding of each liquid crystal panel is the best. However, the gamma encoding is burned in the gamma register such that the online gamma adjustment technology should be applied in a combined model and a separated model cannot be applied. Besides, the online gamma adjustment requires a port directly connected with the gamma register. An interference signal of the port may affect the gamma encoding stored in the register so that the gamma encoding is modified wrongly.

SUMMARY OF THE INVENTION

In order to overcome the shortage of the conventional art, an exemplary embodiment of the present invention provides an online gamma adjustment system of liquid crystal panel.

According to an exemplary embodiment of the present invention, an online gamma adjustment system of liquid crystal panel is provided, and comprising: a port receiving a gamma encoding for adjusting from an external gamma adjustment device, and generating an enable signal; a storage device storing the gamma encoding for adjusting received by the port according to a voltage level status of the enable signal; a controller selectively reading the gamma encoding from the storage device according to voltage level status of the enable signal; and a gamma register receiving the gamma encoding read by the controller, outputting a gamma voltage corresponding to the gamma encoding read by the controller in order to drive a liquid crystal panel.

Optionally, the storage device stores the gamma encoding for adjusting received from the port when the voltage level status of the enable signal is at a high voltage level.

Optionally, the controller read the gamma encoding from the storage device when the voltage level status of the enable signal is at a low voltage level, and the gamma encoding read by the controller is received by the gamma register.

Optionally, the system further comprises a switch, the switch is located between the port and the storage device, the controller and the gamma register, and the switch is configured to be connected or disconnected according to the voltage level status of the enable signal.

Optionally, the switch is connected when the voltage level status of the enable signal is at the high voltage level, and is disconnected when the voltage level status of the enable signal is at the low voltage level.

Optionally, the storage device is an Electrically Erasable Programmable Read-Only Memory (EEPROM), and the EEPROM stores the gamma encoding received by the port when the voltage level status of the enable signal inputted into the EEPROM is at a low voltage level.

Optionally, the system further includes an inverter, the inverter is connected between the EEPROM and the port, and is configured to invert the voltage level status of the enable signal inputted to EEPROM.

Optionally, the storage device is a flash memory, and the flash memory stores the gamma encoding received by the port when the voltage level status of the enable signal is at a high voltage level.

Optionally, the controller read the gamma encoding stored in the flash memory through a serial bus when the voltage level status of the enable signal is at a low voltage level.

Optionally, the gamma encoding received by the port is stored in the storage device according to an address information.

The following description partially illustrate another aspect and/or advantages of the present invention, and another portion of the present invention is clear through description, or can be understood through the embodiments of the present invention.

BRIEF DESCRIPTION OF THE DRAWINGS

Through following to combine figures to describe in detail, the above, the other purposes, the features and benefits of the exemplary embodiment of the present disclosure will become clearer, wherein.

DETAILED DESCRIPTION OF THE PREFERRED EMBODIMENT

The following will describe the exemplary embodiments of the present invention detail. A same numeral in the entire specification and figures represents a same element. The following will refer to the drawings to illustrate the embodiments in order to explain the present invention.

It can be understood that the public embodiments are only exemplary, and the other embodiments can adopt various replacement forms. The drawings are not shown proportionally. Some features are enlarged or minimized in order to show details of specific components. The public specific structure and function cannot be explained as a limitation of the present invention, and only used for teaching the person skilled in the art for a representative basis of using the present invention. The person skilled in the art can understand that the feature referred to any drawing and description can be combined with one or more features described in other drawings in order to generate embodiments not clearly described. The features described are used for representative embodiments in a typical application. However, multiple combinations and transformations consistent with the teaching of the present invention can be applied in a specific application and embodiments.

Figure 1:
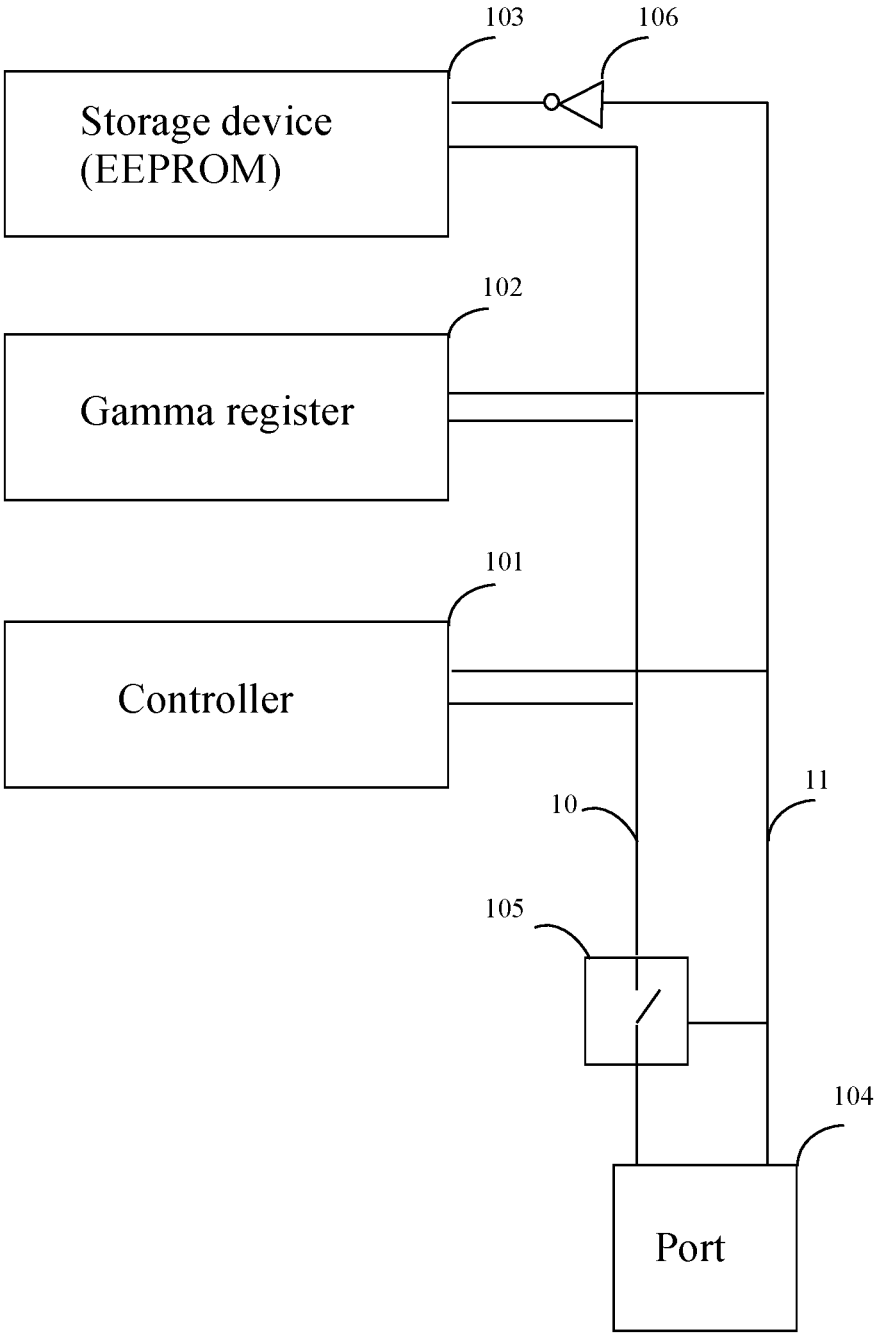
FIG. 1 is a block diagram of an online gamma adjustment system of liquid crystal panel according to an embodiment of the present invention.

FIG. 1 is a block diagram of an online gamma adjustment system of liquid crystal panel according to an embodiment of the present invention.

With reference to FIG. 1, the online gamma adjustment system of liquid crystal panel includes a controller 101, a gamma register 102, a storage device 103, and a port 104.

The controller 101 can be a timing controller of a liquid crystal panel, and the storage device 103 can be an Electrically Erasable Programmable Read-Only Memory (EEPROM) or an EEPROM of the timing controller. Optionally, the system further includes a switch 105 and an inverter 106. The switch 105 is located between the port 104 and the controller 101, the gamma register 102 and the EEPROM 103. The inverter 106 is connected between the EEPROM 103 and the port 104. The controller 101, the gamma register 102, the EEPROM 103, the port 104 and the switch 105 are connected with each other through an $I^2C$ bus 10. In an exemplary embodiment, the port 104 can receive a gamma encoding for adjusting from an external gamma adjustment device, and the port 104 can also generate an enable signal such that the enable signal can be transmitted to the controller 101, the gamma register 102, the EEPROM 103 and the switch 105 through a signal line 11. Wherein, the signal line 11 can be any type of signal line which can transmit two types of voltage level statuses (a high voltage level status and a low voltage level status) and the signal line 11 is not connected with the external environment.

The controller 101 can identify the voltage level status of the enable signal passing through the signal line 11, and has a setting based on the voltage level status of the enable signal. For example, when the voltage level status of the enable signal is at a high voltage level, the controller 101 can identify the high voltage level, and set a status of the controller 101 itself as a slave mode. In the slave mode, the controller 101 can only be written (written into the EEPROM 103), and cannot read or operate other components. When the voltage level status of the enable signal is at a low voltage level, the controller 101 can identify the low voltage level, and set the controller 101 itself as a master mode. In the master mode, the controller 101 can read and operate other components.

In the exemplary embodiment, the EEPROM 103 is in a writable status or an unwritable status corresponding to the voltage level status of the enable signal. For example, when the voltage level status of the enable signal is at a high voltage level, the status of the EEPROM 103 is at the unwritable status, under the unwritable status, information stored in the EEPROM 103 (for example, the gamma encoding stored in the EEPROM 103) can only be read by other components (such as the controller 101), and cannot be written. When the voltage level status of the enable signal is at a low voltage level, the status of the EEPROM 103 is at the writable status. Under the writable status, the EEPROM 103 can be written with a new information (such as a gamma encoding for adjusting).

Optionally, the switch 105 is at a connected status or a disconnected status corresponding to the voltage level status of the enable signal. For example, the switch 105 may be at the connected status when the enable signal is at the high voltage level, and at the disconnected status when the enable signal is at the low voltage level.

In the exemplary embodiment, when online adjusting the gamma encoding stored in the EEPROM 103, an external gamma adjustment device can be connected at the port 104, and setting the voltage level of the enable signal at a high voltage level. At the high voltage level, the switch 105 is connected, the $I^2C$ bus 10 is connected with the port 104, and the controller 101 is at a slave mode. Because of the inverter 106, the enable signal inputted into the EEPROM 103 is at a low voltage level. Accordingly, the EEPROM 103 is at a writable status, the external gamma adjustment device can write a gamma encoding for adjusting into the EEPROM 103.

Optionally, each component (the controller 101, the gamma register 102 and the EEPROM 103) can have a unique address. The gamma encoding can be written into the EEPROM 103 according to the unique address.

In an exemplary embodiment, when the enable signal is at a low voltage level, the switch 105 is disconnected, and the controller 101 is in a master mode. By the function of the inverter 106, the enable signal inputted into the EEPROM 103 is at a high voltage level. Accordingly, the EEPROM 103 is unwritable. The controller 101 can read the gamma encoding stored in the EEPROM 103 through the $I^2C$ bus 10, the gamma register 102 can receive the gamma encoding read by the controller 101 through the $I^2C$ bus 10, and output a corresponding gamma voltage to drive the liquid crystal panel according to the gamma encoding.

In the above embodiment, the gamma encoding can be online adjusted according to the voltage level status of the enable signal. For example, in a default mode, the voltage level status of the enable signal is at a low voltage status. When online adjustment of the gamma encoding is required, switching the voltage level status of the enable signal to a high voltage level status, and the controller 101 is in a slave mode. The enable signal inputted to the EEPROM 103 through the inverter 106 is at a low voltage level status. Accordingly, the EEPROM 103 is in a writable status. The external gamma adjustment device can write a gamma encoding to the EEPROM 103 according to the unique address. When finished, the voltage level status of the enable signal is switched to a low voltage level status, the status of each component (the controller 101, the gamma register 102 and the EEPROM 103) is changed correspondingly. Besides, the controller 101 read a gamma encoding for adjusting stored in the EEPROM 103, and then, the gamma register 102 receives the gamma encoding for adjusting, and drives a liquid crystal panel according to the gamma encoding for adjusting. Through the switching of the voltage level status of the enable signal, online adjustment of the gamma encoding can be realized. Besides, when the online adjustment of the gamma encoding is not required, because the disconnection of the switch 105, each component (the controller 101, the gamma register 102 and the EEPROM 103) and the port 104 are disconnected such that each component will not be affected by the external environment.

Figure 2:
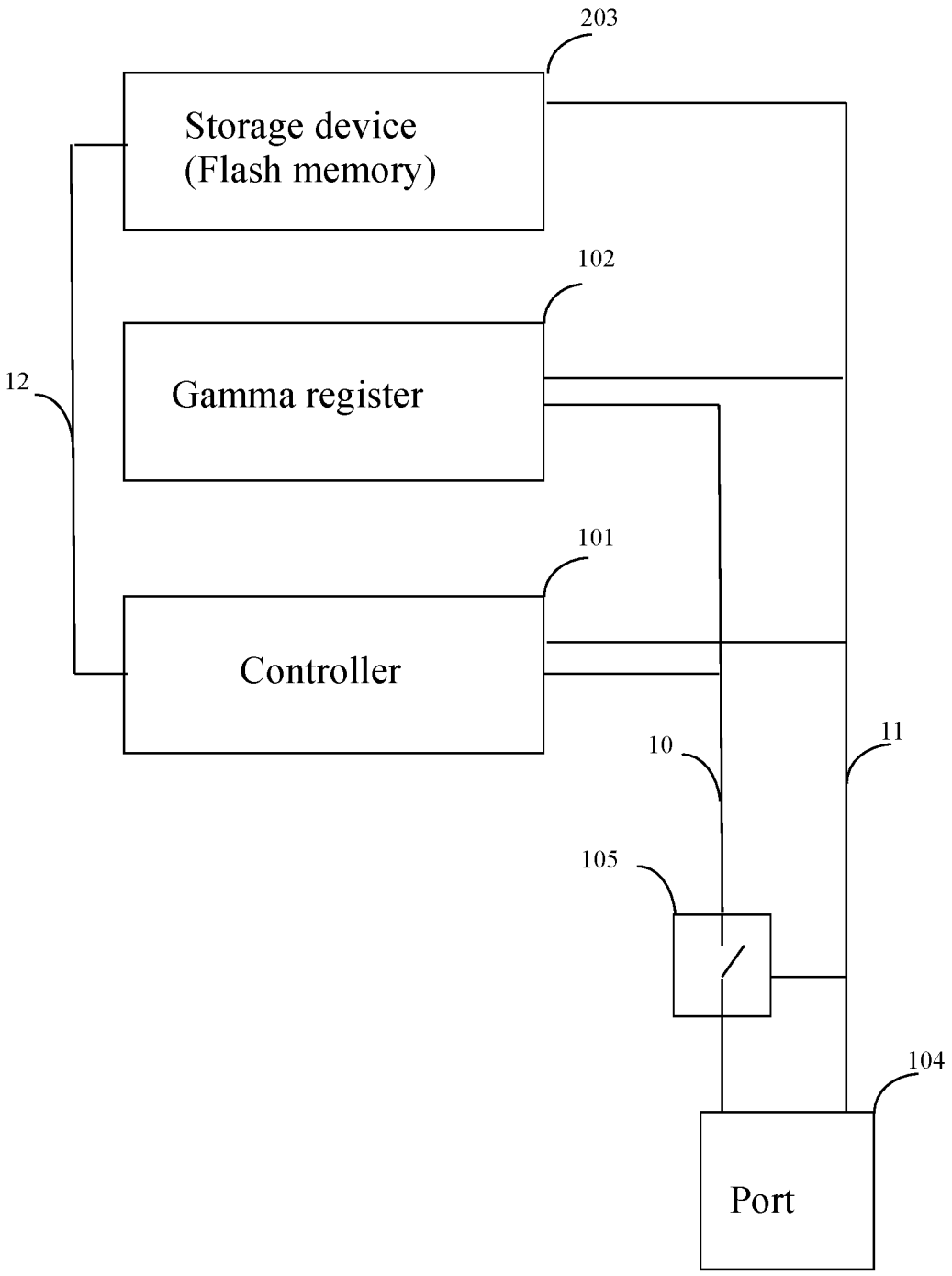
FIG. 2 is a block diagram of an online gamma adjustment system of liquid crystal panel according to another embodiment of the present invention.

FIG. 2 is a block diagram of an online gamma adjustment system of liquid crystal panel according to another embodiment of the present invention.

With reference to FIG. 2, the online gamma adjustment system of liquid crystal panel includes a controller 101, a gamma register 102, a storage device 203, and a port 104. The controller can be a timing controller of a liquid crystal panel, and the storage device 203 can be a flash memory or a flash memory of the timing controller. Optionally, the system further includes a switch 105, and the switch 105 is located between the port 104 and the controller 101, the gamma register 102 and the flash memory 203.

In an exemplary embodiment, the port 104 can receive a gamma encoding for adjusting from an external gamma adjustment device, and the port 104 can also generate an enable signal such that the enable signal can be transmitted to the controller 101, the gamma register 102, the flash memory 203 and the switch 105 through the signal line 11. Wherein, the signal line 11 can be any type of signal line which can transmit two types of voltage level statuses (a high voltage level status and a low voltage level status) and the signal line 11 is not connected with the external environment.

The controller 101 can identify the voltage level status of the enable signal passing through the signal line 11, and has a setting based on the voltage level status of the enable signal. For example, when the voltage level status of the enable signal is at a high voltage level, the controller 101 can identify the high voltage level, and set a status of the controller 101 itself as a slave mode. In the slave mode, the controller 101 can only be written (written into the flash memory 203), and cannot read or operate other components. When the voltage level status of the enable signal is at a low voltage level, the controller 101 can identify the low voltage level, and set the controller 101 itself as a master mode. In the master mode, the controller 101 can read and operate other components.

In the exemplary embodiment, the flash memory 203 is in a writable status or an unwritable status corresponding to the voltage level statuses of the enable signal. For example, when the voltage level status of the enable signal is at a low voltage status, the status of the flash memory 203 is in the unwritable status, under the unwritable status, information stored in the flash memory 203 (for example, the gamma encoding stored in the flash memory 203) can only be read by other components (such as the controller 101), and cannot be written. When the voltage level status of the enable signal is at a high voltage status, the status of the flash memory 203 is in the writable status. Under the writable status, the flash memory 203 can be written with a new information (such as a gamma encoding for adjusting).

Optionally, the switch 105 is at a connected status or a disconnected status corresponding to the voltage level status of the enable signal. For example, the switch 105 can be at the connected status when the enable signal is at the high voltage level status, and at the disconnected status when the enable signal is at the low voltage level status.

In the exemplary embodiment, when online adjusting the gamma encoding stored in the flash memory 203, an external gamma adjustment device can be connected at the port 104, and setting the voltage level status of the enable signal at a high voltage level. In the high voltage level, the switch 105 is connected, the $I^2C$ bus 10 is connected with the port 104, and the controller 101 is at a slave mode, and the flash memory 203 is at a writable status, the external gamma adjustment device can write a gamma encoding for adjusting into the flash memory 203.

Optionally, each component (the controller 101, the gamma register 102 and the flash memory 203) can have a unique address. The gamma encoding can be written into the flash memory 203 of the controller 101 according to the unique address.

In an exemplary embodiment, when the enable signal is at a low voltage level, the switch 105 is disconnected, and the controller 101 is in a master mode, and the flash memory 203 is unwritable. The controller 101 can read the gamma encoding stored in the flash memory 203 through the serial bus 12, the gamma register 102 can receive the gamma encoding read by the controller 101 through the $I^2C$ bus 10, and output a corresponding gamma voltage to drive the liquid crystal panel according to the gamma encoding.

In the above embodiment, the gamma encoding can be online adjusted according to the voltage level status of the enable signal. For example, in a default mode, the voltage level status of the enable signal is at a low voltage status. When online adjusting the gamma encoding is required, switching the voltage level status of the enable signal to a high voltage level status, and the controller 101 is in a slave mode, and the flash memory 203 is in a writable status. The external gamma adjustment device can write a gamma encoding into the flash memory 203 according to the unique address. When finished, the voltage level status of the enable signal is switched to a low voltage level status, the status of each component (the controller 101, the gamma register 102 and the flash memory 203) is changed correspondingly, and the switch is disconnected. Besides, the controller 101 read a gamma encoding for adjusting stored in the flash memory 203, and then, the gamma register 102 receives the gamma encoding for adjusting, and drives a liquid crystal panel according to the gamma encoding for adjusting. Through the switching of the voltage level status of the enable signal, online adjustment of the gamma encoding can be realized. Besides, when the online adjustment of the gamma encoding is not required, because the disconnection of the switch 105, each component (the controller 101, the gamma encoding register 102 and the flash memory 203) and the port 104 are disconnected such that each component will not be affected by the external environment.

Figure 3:
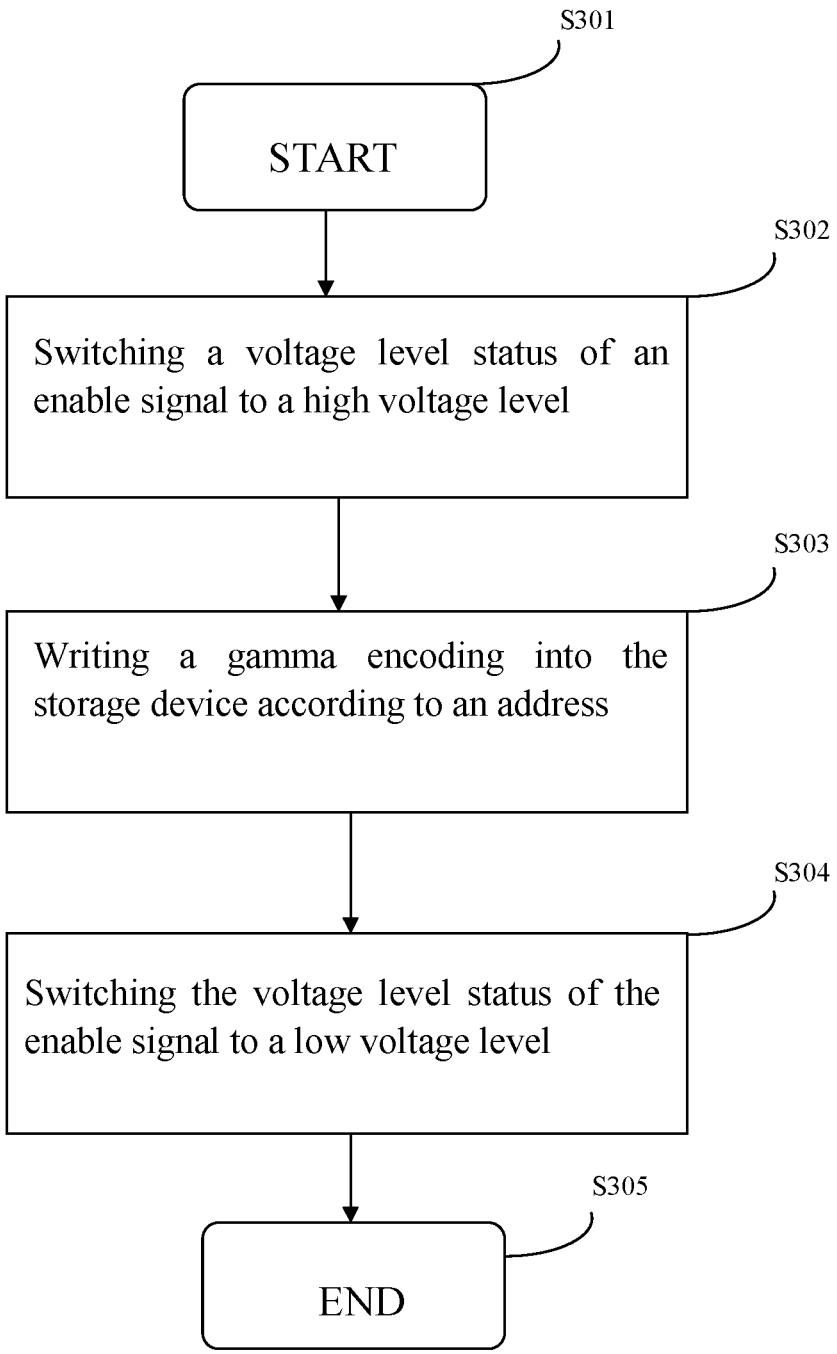
FIG. 3 is a flow chart of an online gamma adjustment system of liquid crystal panel according to an embodiment of the present invention.

FIG. 3 is a flow chart of an online gamma adjustment system of liquid crystal panel according to an embodiment of the present invention.

The gamma register can output a gamma voltage according to a gamma encoding in order to drive a liquid crystal panel. In the above embodiments, the gamma encoding is stored in the storage device (EEPROM 103 or flash memory 203). The controller 101 can read the gamma encoding stored in the storage device and write the read gamma encoding to the gamma register. When an online adjustment of gamma encoding is required, following operations can be executed.

In a step S301, the operation is started. In the step, connecting an external gamma adjustment device to a port 104.

In executing a step S302, switching a voltage level status of an enable signal to a high voltage level status. In the step, the voltage level status of the enable signal is switched to a high voltage level status from a low voltage level status of a default mode. At this time, the controller 101 is in a slave mode, if the storage device is a flash memory 203, the enable signal with the high voltage level status is inputted into the flash memory 203. Accordingly, the flash memory 203 is in a writable status. If the storage device is an EEPROM 103, the enable signal with the high voltage level status is inputted into the EEPROM 103 through an inverter. Accordingly, the status of the enable signal inputted into the EEPROM 103 is at a low voltage level status such that the EEPROM is at a writable status. At the same time, the switch 105 is connected so that the port 104 is connected with the controller 101, the gamma register 102 and the EEPROM 103 or the flash memory 203 such that a gamma encoding for adjusting can be received from an external gamma adjustment device.

In a step S303, the gamma encoding for adjusting can be written into the storage device according to an address. Each of the controller 101, the gamma register 102, the EEPROM 103 and the flash memory 203 has a unique address. Therefore, the gamma encoding for adjusting can be written into the storage device (EEPROM 103 or the flash memory 203) according to the unique address.

In a step S304, switching the voltage level status of the enable signal to a low voltage level status. After writing the gamma encoding for adjusting is finished, switching the voltage level status of the enable signal to a low voltage level. The controller 101 is at a master mode. If the storage device is a flash memory 203. The enable signal with the low voltage level status is inputted into the flash memory 203. Therefore, the flash memory 203 is at an unwritable status, if the storage device is EEPROM 103, the enable signal with the low voltage level status is inputted into the EEPROM 103 through the inverter. Therefore, the status of the enable signal inputted into the EEPROM 103 is at a high voltage level status so that the EEPROM is at an unwritable status. At the same time, the switch 105 is disconnected without receiving a gamma encoding from an external gamma adjustment device so as to avoid affection by the external environment, and the gamma encoding stored in the storage device to be modified incorrectly.

In the step S305, the operation is end. After the adjustment is finished, the controller 101 can read the gamma encoding for adjusting stored in the EEPROM 103 through the $I^2C$ bus 10 or a serial bus 12 to read the gamma encoding for adjusting stored in the flash memory 203. The gamma register 102 can receive the gamma encoding for adjusting through the $I^2C$ bus 10 and outputs a corresponding gamma voltage to drive the liquid crystal panel.

The above embodiments of the present invention are only exemplary, however, the present invention is not limited. The person skilled in the art can understand: without exceeding the principle and spirit of the present invention, the above embodiments can be improved. The features of the embodiments can be combined or replaced equivalently to form other embodiments not described or shown clearly. The scope of the present invention is limited in the claims and the equivalents of the claims.

What is claimed is:

1. An online gamma adjustment system of liquid crystal panel, comprising:

a port receiving a gamma encoding for adjusting from an external gamma adjustment device, and generating an enable signal;

a storage device storing the gamma encoding for adjusting received by the port according to a voltage level status of the enable signal;

a controller selectively reading the gamma encoding from the storage device according to voltage level status of the enable signal; and a gamma register receiving the gamma encoding read by the controller and outputting a gamma voltage corresponding to the gamma encoding read by the controller in order to drive a liquid crystal panel.

2. The online gamma adjustment system of liquid crystal panel according to claim 1, wherein the storage device stores the gamma encoding for adjusting received from the port when the voltage level status of the enable signal is at a high voltage level.

3. The online gamma adjustment system of liquid crystal panel according to claim 1, wherein the controller read the gamma encoding from the storage device when the voltage level status of the enable signal is at a low voltage level, and the gamma encoding read by the controller is received by the gamma register.

4. The online gamma adjustment system of liquid crystal panel according to claim 1, wherein the system further comprises a switch, the switch is located between the port and the storage device, the controller and the gamma register, and the switch is configured to be connected or disconnected according to the voltage level status of the enable signal.

5. The online gamma adjustment system of liquid crystal panel according to claim 4, wherein the switch is connected when the voltage level status of the enable signal is at the high voltage level, and is disconnected when the voltage level status of the enable signal is at the low voltage level.

6. The online gamma adjustment system of liquid crystal panel according to claim 1, wherein the storage device is an Electrically Erasable Programmable Read-Only Memory (EEPROM), and the EEPROM stores the gamma encoding received by the port when the voltage level status of the enable signal inputted into the EEPROM is at a low voltage level.

7. The online gamma adjustment system of liquid crystal panel according to claim 6, wherein the system further includes an inverter, the inverter is connected between the EEPROM and the port, and is configured to invert the voltage level status of the enable signal inputted to EEPROM.

8. The online gamma adjustment system of liquid crystal panel according to claim 1, wherein the storage device is a flash memory, and the flash memory stores the gamma encoding received by the port when the voltage level status of the enable signal is at a high voltage level.

9. The online gamma adjustment system of liquid crystal panel according to claim 8, wherein the controller read the gamma encoding stored in the flash memory through a serial bus when the voltage level status of the enable signal is at a low voltage level.

10. The online gamma adjustment system of liquid crystal panel according to claim 1, wherein the gamma encoding received by the port is stored in the storage device according to an address information.

* * * * *